US006971553B2

(12) United States Patent
Brennan et al.

(10) Patent No.: US 6,971,553 B2
(45) Date of Patent: Dec. 6, 2005

(54) PUMP FOR DISPENSING FLOWABLE MATERIAL

(76) Inventors: James William Brennan, 24 Lovelle Street, Moss Vale, NSW 2577 (AU); Peter Russell Brewer, 29 Caledonia Street, Paddington, NSW 2021 (AU)

( * ) Notice: Subject to any disclaimer, the term of this patent is extended or adjusted under 35 U.S.C. 154(b) by 0 days.

(21) Appl. No.: 10/496,937

(22) PCT Filed: Jul. 4, 2001

(86) PCT No.: PCT/AU01/00801

§ 371 (c)(1),
(2), (4) Date: May 25, 2004

(87) PCT Pub. No.: WO02/02423

PCT Pub. Date: Jan. 10, 2002

(65) Prior Publication Data

US 2005/0035157 A1 Feb. 17, 2005

(51) Int. Cl.[7] ..... B65D 37/00
(52) U.S. Cl. ..... 222/207; 222/380; 222/518; 222/212
(58) Field of Search ..... 222/207, 212, 222/494, 380, 518

(56) References Cited

U.S. PATENT DOCUMENTS

| | | | | |
|---|---|---|---|---|
| 3,995,776 | A | 12/1976 | Micallef | |
| 4,776,495 | A | 10/1988 | Vignot | |
| 4,804,115 | A | 2/1989 | Ball | |
| 5,377,880 | A * | 1/1995 | Moretti | 222/207 |
| 5,454,488 | A | 10/1995 | Geier | |
| 5,971,224 | A * | 10/1999 | Garibaldi | 222/207 |
| 6,334,522 | B2 | 1/2002 | Bougamont et al. | |

FOREIGN PATENT DOCUMENTS

| | | |
|---|---|---|
| FR | 2618760 A1 | 2/1989 |
| FR | 2714027 A | 6/1995 |
| WO | WO 99/01770 A | 1/1999 |
| WO | WO 99/02272 A | 1/1999 |
| WO | WO 00/20294 A1 | 4/2000 |

* cited by examiner

*Primary Examiner*—Philippe Derakshani
(74) *Attorney, Agent, or Firm*—The Webb Law Firm

(57) ABSTRACT

The invention relates to a dispensing device which can be used to dispense a metered volume of a flowable material such as a liquid, gel or paste product from a reservoir. The invention provides a pump for dispensing a flowable material from a container, the pump including a pump body which is deformable between a rest configuration and a squeezed configuration, the internal capacity of the pump body being substantially reduced in the squeezed configuration compared to the rest configuration.

18 Claims, 10 Drawing Sheets

PUMP FOR DISPENSING FLOWABLE MATERIAL

FIELD OF THE INVENTION

The present invention relates to dispensing apparatus for dispensing a flowable material from a reservoir. More particularly, the invention relates to a dispensing device which can be used to dispense a metered volume of a flowable material such as a liquid, gel or paste product from a reservoir.

BACKGROUND OF THE INVENTION

A number of pumps for dispensing a flowable material from a reservoir are currently known. One common type is a positive displacement pump which generally comprises a spout mounted atop a hollow plunger assembly which extends downwardly into a complementary cylinder. In order to dispense a volume of material the user places one hand under the spout and depresses the plunger with the other hand. By means of various valves, depressing the plunger causes the flowable material to be dispensed from the spout. The plunger is spring loaded so that it returns to its original position upon release, whilst refilling the cylinder in readiness for the next plunger depression. A disadvantage with this type of pump is the limited amount of material which may be dispensed with a single depression of the plunger. Whilst this problem may be overcome by increasing the size of the assembly, the plunger and its associated hardware must be rigid enough to resist the forces acting upon them, which in turn increases production costs. Similarly, the container itself must be rigid, as must the connection between the pump and the container, which can lead to the assembly being relatively expensive.

Another type of dispensing pump is mounted at the bottom of the reservoir, thereby doing away with much of the internal piping. However, the mountings and the container itself must still be rigid, which again leads to additional cost.

The relatively expensive nature of such prior art pumping systems has meant that they are generally not incorporated into disposable items. This is acknowledged by the widespread availability of "refills" for most commercially available dispensers.

Unfortunately, particularly in environments where hygiene is essential such as surgeries and the like, the build-up of dirt and bacteria around those components of the pump which come into contact with the surrounding environment and human hands can prove problematic. Whilst these non-disposable components may periodically be cleaned and sanitised, this is a time consuming job which is often not undertaken on a sufficiently regular or thorough basis.

It is an object of the present invention to overcome or ameliorate at least one of the disadvantages of the prior art, or to provide a useful alternative.

SUMMARY OF THE INVENTION

Accordingly, the invention provides a pump for dispensing a flowable material from a container, said pump including:

a pump body deformable between a rest configuration and a squeezed configuration, the internal capacity of the pump body being substantially reduced in the squeezed configuration compared to the rest configuration;

a unidirectional valve to allow ingress of said flowable material into said pump body from said container;

an outlet to allow egress of said flowable material from said pump body;

such that squeezing of said pump body pumps said flowable material from said container.

Preferably, the pump body is integrally formed from a resilient material. In a preferred embodiment, the pump body is moulded from a silicon or rubber-like material.

Preferably the pump can be adapted to be attached to a flexible bag or a rigid container (bottle, box or folded board).

Preferably the unidirectional valve is a flap valve.

Preferably the pump body is formed as a flexible one piece outer shroud.

In one preferred embodiment the pump body includes a nozzle section which is formed as a flexible conical "funnel" which engages on a sealing member located inside the pump body to seal the outlet of the pump body.

In a preferred embodiment, the pump includes a sealing member located inside the pump body which acts to seal the outlet of the pump body. Preferably the sealing member is located on the longitudinal axis of the pump body and is slidably mounted for translational movement.

It is further preferable that the pump includes an internal frame member which includes a boss through which the sealing member extends.

Preferably the pump also includes a flap valve mounted on the internal frame member which is configured to prevent the ingress of air into the pump body upon the completion of a pumping action.

In a further preferred embodiment the pump body is formed with a bellows section which is symmetrical about the vertical plane, but is shaped in a way to provide an asymmetrical aspect when viewed from the front and the rear. The head can be activated from either side or from both sides, therefore increasing its efficiency (creating a higher dosage pump on a smaller "footprint").

The asymmetry does this as the head is activated the tension and length of the surface skin "subtly" unloads the nozzle tips. This allows the material to dispense more easily. The pressure inside the chamber seals the upper end of the void (conventional flap valves), and forces the expansion of the head in the nozzle area. As the limit of the stroke is reached the pressure equalises and the nozzle seals itself again. This causes the chamber to open again and draw material back in the fill the void preparing the pump for the next stroke.

The cross-section of the part can be either elliptical or circular, and its ease of manufacture means it can be put up to a variety of configurations. The efficacy of the valve means that a diverse range of materials can be applied from orange juice, paints, gels, antiseptic liquids etc.

The present invention provides advantages in terms of cost efficiency, ability to eliminate contamination and cross-infection, and the control of inventory of materials.

BRIEF DESCRIPTION OF THE DRAWINGS

A number of preferred embodiments of the invention will now be described, by way of example only, with reference to the accompanying drawings in which.

PREFERRED EMBODIMENT OF THE INVENTION

Figure 1:
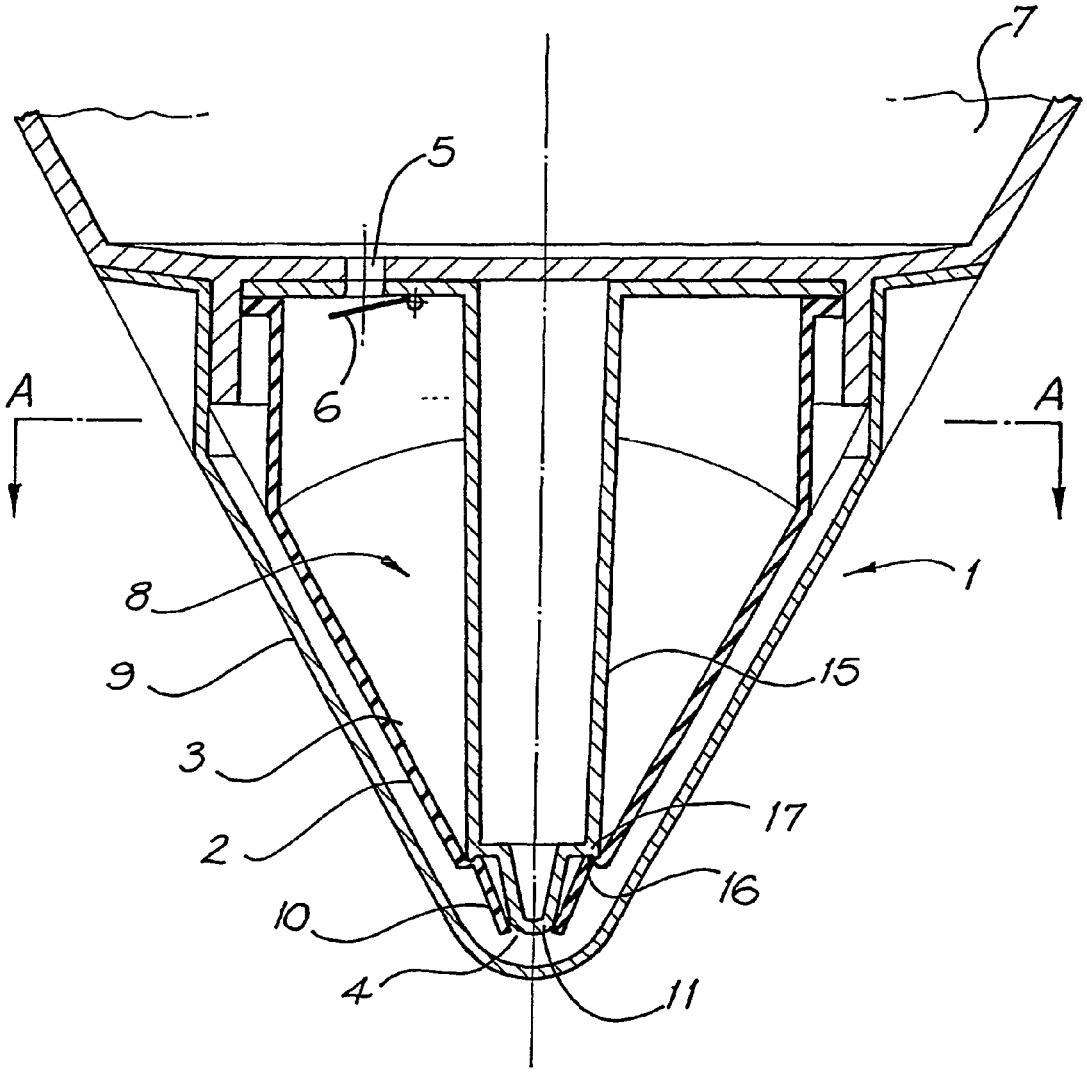
FIG. 1 depicts a cross-sectional elevation view of a first preferred embodiment of the dispenser.
Figure 2:
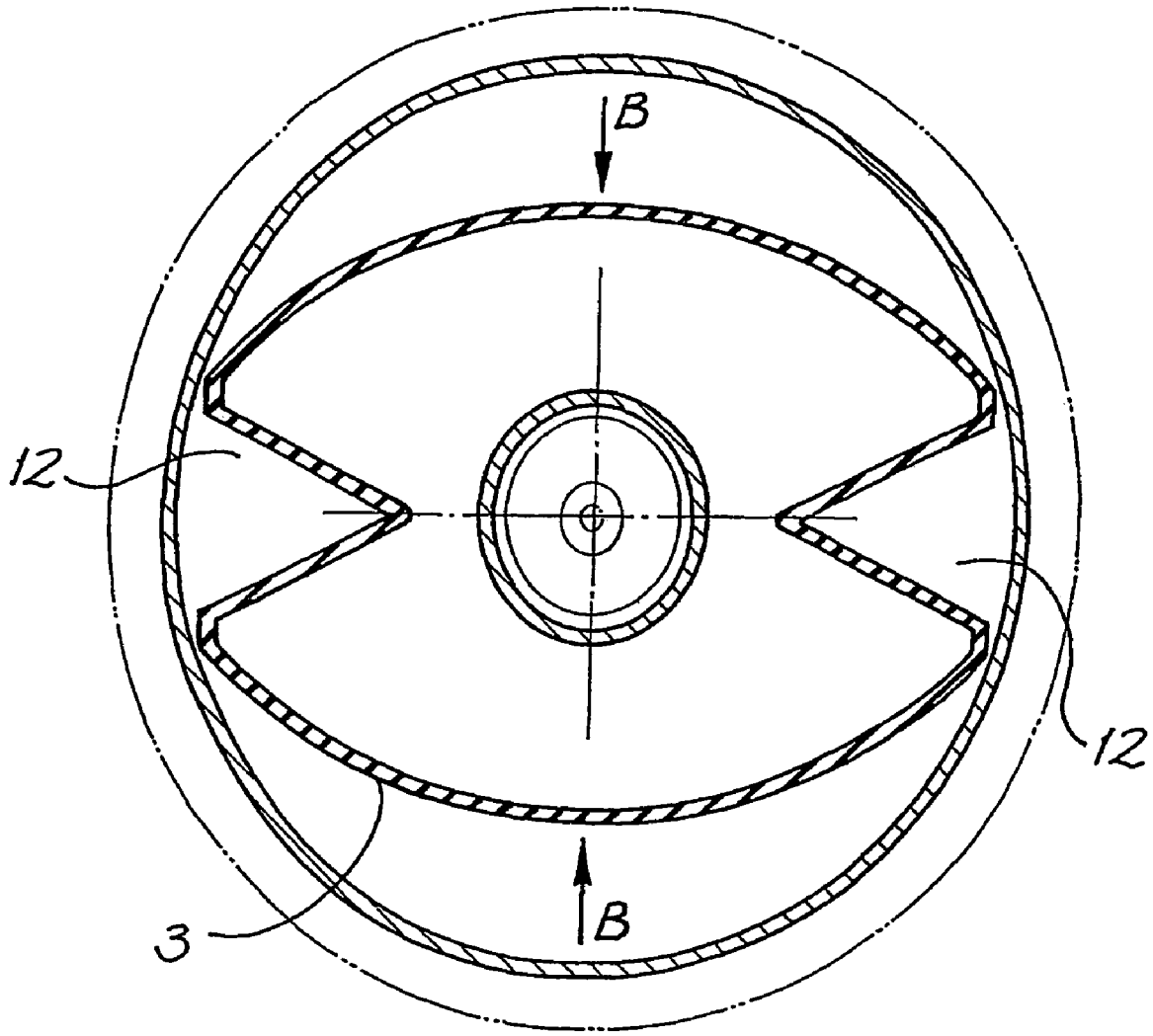
FIG. 2 depicts a transverse cross-sectional view taken along line A—A of FIG. 1.

Referring to FIGS. 1 and 2 of the accompanying drawings, a preferred embodiment of the dispensing device according to the present invention is depicted. The pump 1 includes a pump body 2 formed by a flexible walled member 3. The pump includes an outlet 4 from which flowable material is dispensed and an inlet 5 which is controlled by a unidirectional valve 6. The material to be dispensed flows through the inlet 5 via the valve 6 from a reservoir (not shown) positioned in region 7.

When closed, the flap valve 6 seals the orifice 5 to prevent the reverse flow of material from the pump chamber 8 back into the reservoir 7. In FIG. 1, the pump is depicted with a removable cap or cover 9 fitted over the outlet and walls of the pump body.

The pump body 2 includes a nozzle section 10 which is formed as a flexible funnel with a relatively low ramp angle and terminating with the outlet 4. The pump further includes a relatively rigid internal member 15 which lies on the longitudinal axis of the pump. The internal member 15 is provided with a rounded nose 11 which seats against the internal wall of the nozzle section 10 so as to provide sealing of the outlet 4. The upper end of the nozzle section 10 is provided with a ridge 16 which seats against a shoulder 17 on the internal member 15. In use, the nozzle section deforms outwardly under the internal pressure so as to dispense an amount of flowable material, the volume of which is preferably controllable by the operator. The shoulder 17 on the internal member 15 provides a pivot point for the outward movement of the nozzle section when deformed under pressure. To further assist in this action, the upper end of the nozzle 10 may be provided with a small annular cut out in the region of the ridge 16 so as to allow the nozzle 10 to hinge open in the manner described. The internal member 15 may be provided with one or more channels or ports (not shown) in the region of the shoulder 17 so as to allow fluid communication between the pump chamber 8 and the outlet 4 when the nozzle section 10 is deformed.

The pump body 2 is formed with a bellows section 12 which is symmetrical about the vertical plane, but is shaped in a way to provide an asymmetrical aspect when viewed from the front and the rear. The head can be activated from either side or from both sides, therefore increasing its efficiency (creating a higher dosage pump on a smaller "footprint").

The asymmetry does this as the head is activated the tension and length of the surface skin "subtly" unloads the nozzle tips. This allows the material to dispense more easily. The pressure inside the chamber seals the upper end of the void (conventional flap valves), and forces the expansion of the head in the nozzle area. As the limit of the stroke is reached the pressure equalises and the nozzle seals itself again. This causes the chamber to open again and draw material back in the fill the void preparing the pump for the next stroke.

The cross-section of the part can be either elliptical or circular, and its ease of manufacture means it can be put up to a variety of configurations. The efficacy of the valve means that a diverse range of materials can be applied from orange juice, paints, gels, antiseptic liquids etc.

The pump body 2 is deformable between a rest configuration as shown in FIGS. 1 and 2 and a squeezed configuration, the internal capacity of the pump body being substantially reduced in the later configuration. In a preferred embodiment, the walls of the pump body are formed by moulding a resilient material such as silicone or a similar rubber-like material although other materials and production methods may be used.

The pump may be integrally formed with or at least permanently attached to the container thereby reducing the need for means to releasably and sealingly attach the pump to the container.

In use, the pump is used to dispense a flowable material from the inside of the attached container (not shown) the walls are manually squeezed towards each other as shown by arrows B—B in FIG. 2, which increases the pressure within the pump body. This in turn causes the lips of the nozzle section to move apart from the fixed nose section, and for the flowable material from within the pump body to be expelled through the exit orifice 4.

When the walls are released the resilient nature of the walls forces them apart which in turn reduces the pressure within the pump body such that the flap valve 6 opens. Flowable material from within the container is then sucked into the pump chamber 8 ready for the next pumping action.

Figure 3:
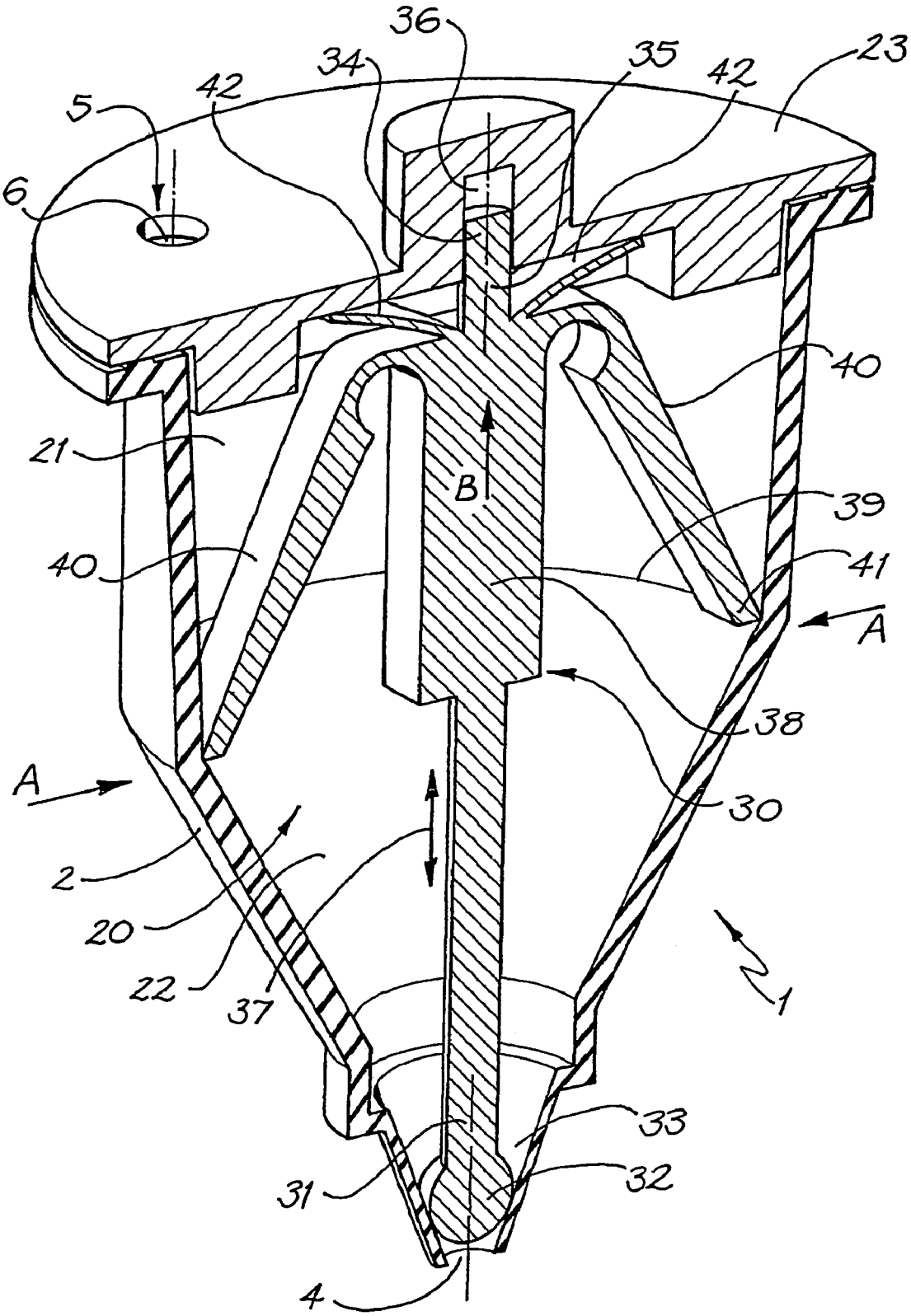
FIG. 3 depicts a perspective cross-sectional view of a second preferred embodiment of the dispenser.

Referring to FIG. 3, a further preferred embodiment of the dispenser is depicted. In this embodiment the pump 1 includes a pump body 2 formed from a flexible walled member. The pump body 2 is formed by moulding a resilient material, such as silicone or a similar rubber-like material, although other materials and production methods may be used. The pump body 2 is deformable between a rest configuration as shown in FIG. 3 and a squeezed configuration, the internal capacity of the pump body being substantially reduced in the latter configuration. In the preferred embodiment depicted, the pump body 2 defines a pump chamber 20 comprising an upper cylindrical section 21 and a lower, conical section 22. A cap 23 is fitted to the open end of the upper cylindrical section 21 so as to close the upper end of the pump chamber. An inlet 5 is located in the cap 23, the inlet being controlled by a unidirectional flap valve 6. The lower conical section 22 includes an outlet 4 from which flowable material is dispensed from the pump chamber. In use, the dispenser is attached to a reservoir (not shown), such as a bag, of flowable material. The material to be dispensed flows through the inlet 5 via the flap valve 6 from the reservoir.

In this embodiment, the pump includes an internal sealing member 30 which acts to control the dispensing of material from the pump chamber 20 via the outlet 4. The internal sealing member 30 is preferably moulded from a flexible, resilient material such as nylon, polypropylene or the like. The sealing member 30 is centrally located on the longitudinal axis of the pump chamber. One end 31 of the sealing member is provided with a rounded nose 32 which seats against the tapered internal wall 33 of the conical section of the outlet so as to provide sealing of the outlet. The opposing end 34 of the member is provided with a locating stem 35 which is slidably received within a mating recess 36 in the cap of the pump to provide for the location and guidance of the sealing member within the pump chamber. The stem 35 is capable of sliding movement within the recess 36 so as to allow the sealing member 30 a degree of translational movement along the longitudinal axis as indicated by the arrows 37.

The sealing member 30 further includes a plurality of arms 40 which extend outwardly and downwardly from the upper body 38 of the member 30, the arms 40 being pivotally attached to the body 38. The free ends 41 of the arms 40 seat against the inner walls of the pump body, and more particularly seat against the inner wall of the pump body at the junction 39 between the upper cylindrical section and the lower conical section of the pump chamber. The resilient nature of the material from which the sealing member 30 is made means that if a dispensing force is applied by a user so as to cause the arms to move inwardly by means of rotation, an opposing restoring force will cause the arms to return to their rest position shown in FIG. 3 upon removal of the dispensing force by the user.

The sealing member 30 further includes a biasing means which acts to bias the sealing member into a position whereby the nose 32 is in sealing engagement with the outlet of the pump body. In the preferred embodiment depicted, the biasing means comprises a pair of opposing fingers 42 which extend from the member and seat against an inner surface of the cap 23. As the member is caused to move towards the cap the flexure of the fingers provides a biasing resistance in the opposing direction such that upon removal of the force by the user the member is caused to move in the opposing direction thereby returning the nose 32 into a sealing position against the inner walls 33 of the outlet 4.

In use, to dispense flowable material the user applies a squeezing force to the pump body in the vicinity of the ends of the opposing arms 40 in the direction indicated by arrows A. The wall of the pump body is deformed inwardly and the arms 40 are caused to pivot inwardly towards the body of the member 30. This causes the member 30 to move in direction B, thereby moving the nose section 32 away from sealing contact with the internal wall 33 of the outlet. In moving upwardly the resilient fingers 42 are caused to be deformed downwardly thereby creating an opposing biasing force. The reduction in the internal volume of the pump chamber 20 causes an increase in the pressure within the pump body thereby causing flowable material to be dispensed from the outlet 4.

When the squeezing force on the wall of the pump body is released the resilient nature of the wall causes it to return to its rest position. The resilient arms 40 spring outwardly upon the release of the squeezing force and the fingers 42 located on the upper end of the sealing member 30 act to return the sealing member to a sealing position shown in FIG. 3.

Whilst the embodiment depicted in FIG. 3 features two opposing arms 40, it is to be appreciated that the internal member may be provided with a greater number of arms. In a further alternative embodiment, the opposing arms may be replaced with a resiliently deformable disc which would provide the same degree of biasing and controlled movement through the deformation of the disk walls upon the application of a dispensing force by a user.

Figure 4:
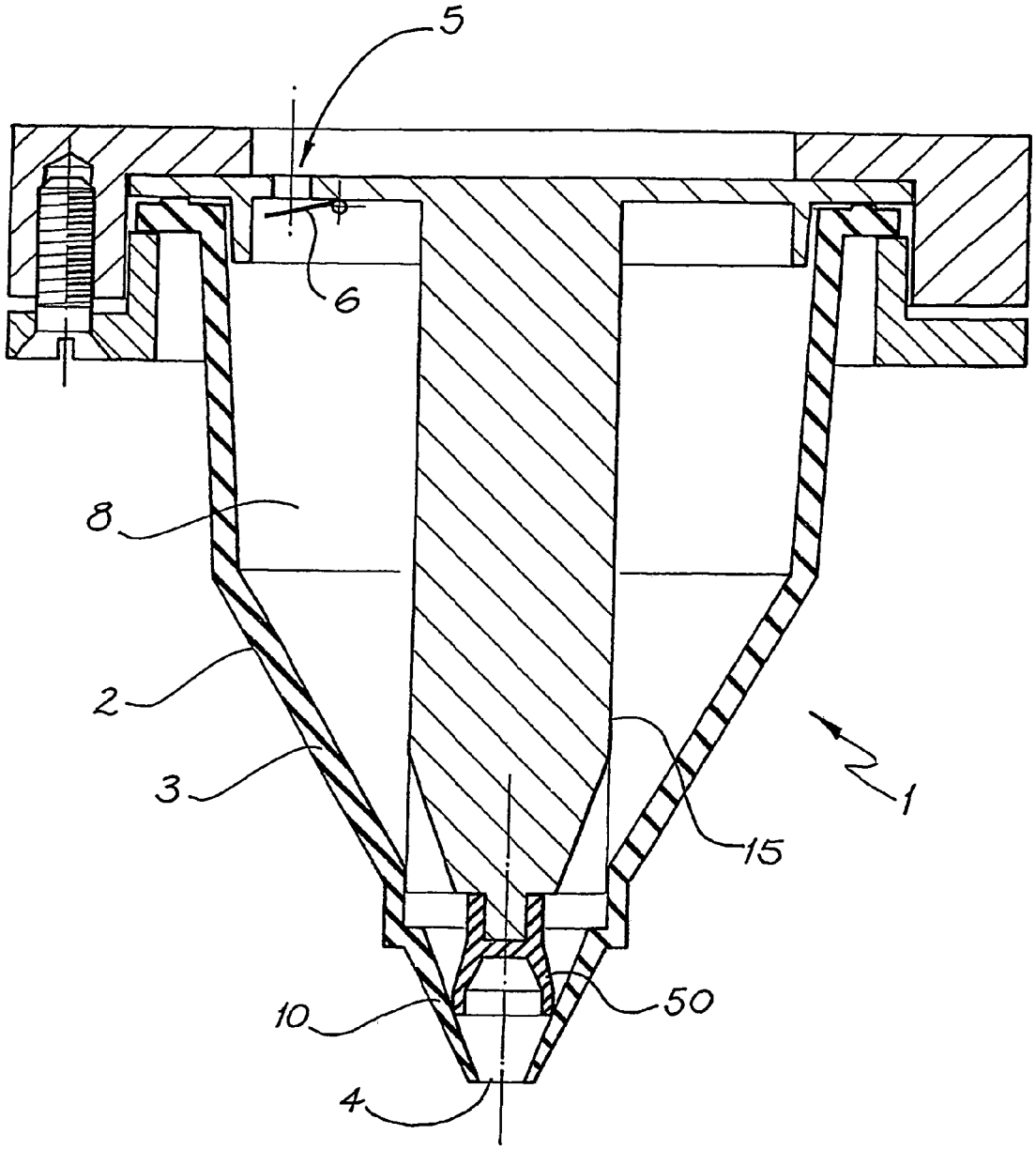
FIG. 4 depicts a cross-sectional elevation view of a third preferred embodiment of the dispenser.
Figure 5:
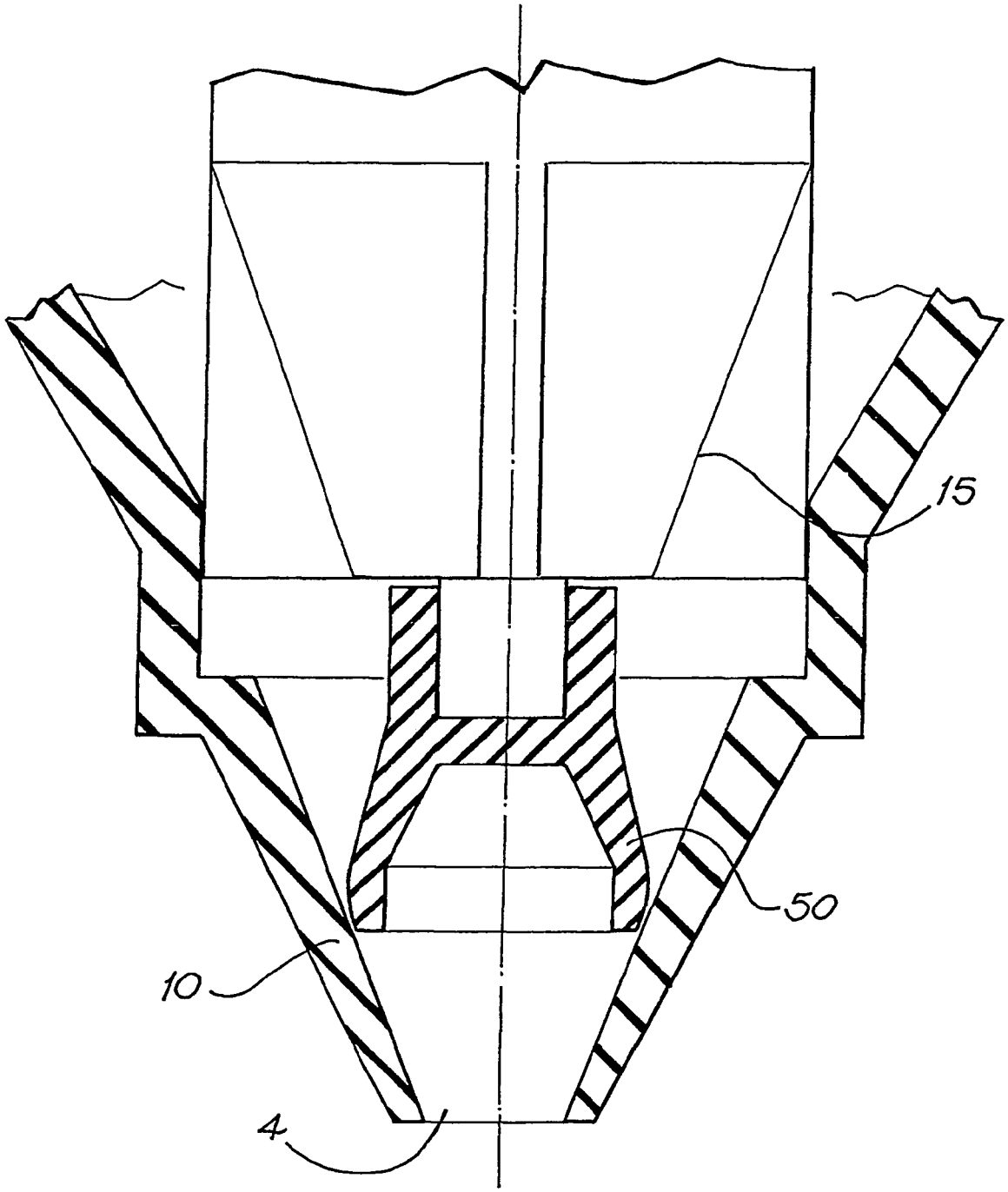
FIG. 5 depicts an enlarged view of the outlet section of the dispenser depicted in FIG. 4.

Referring to FIGS. 4 and 5, a further dispenser assembly depicting aspects of the present invention is shown. In this embodiment, a flexible tip 50 is located in the conical nozzle section 10 of the pump body. The tip 50 is preferably made from the same flexible material as the pump body and is preferably formed by moulding. The tip 50 has a generally cylindrical shape and is profiled so as to seat against the inner wall of the nozzle section to provide sealing of the outlet 4. The flexible tip is located on the end of a fixed inner member 15 as previously described in relation to the embodiment of FIG. 1. In the embodiment depicted in FIGS. 4 and 5 the flexible tip 50 replaces the nose portion 11 of the internal member 15 in FIG. 1. In use, both the walls of the flexible tip 50 and the nozzle section 10 flex under load during dispensing so as to allow flowable material to pass between the tip and the inner wall of the nozzle section and thereby be dispensed through the outlet 4. Upon the dispensing force being removed the internal pressure within the pump chamber is relieved and the walls of the flexible tip and the nozzle section of the pump body return to a sealing position. It has been found that the particular arrangement in FIGS. 4 and 5 increases the volume which can be dispensed for each dispensing action by a user. The remainder of the dispenser design is substantially in accordance with the embodiment depicted in FIG. 1.

FIGS. 6 to 10 depict the features of a particularly preferred embodiment of the dispenser.

Figure 6:
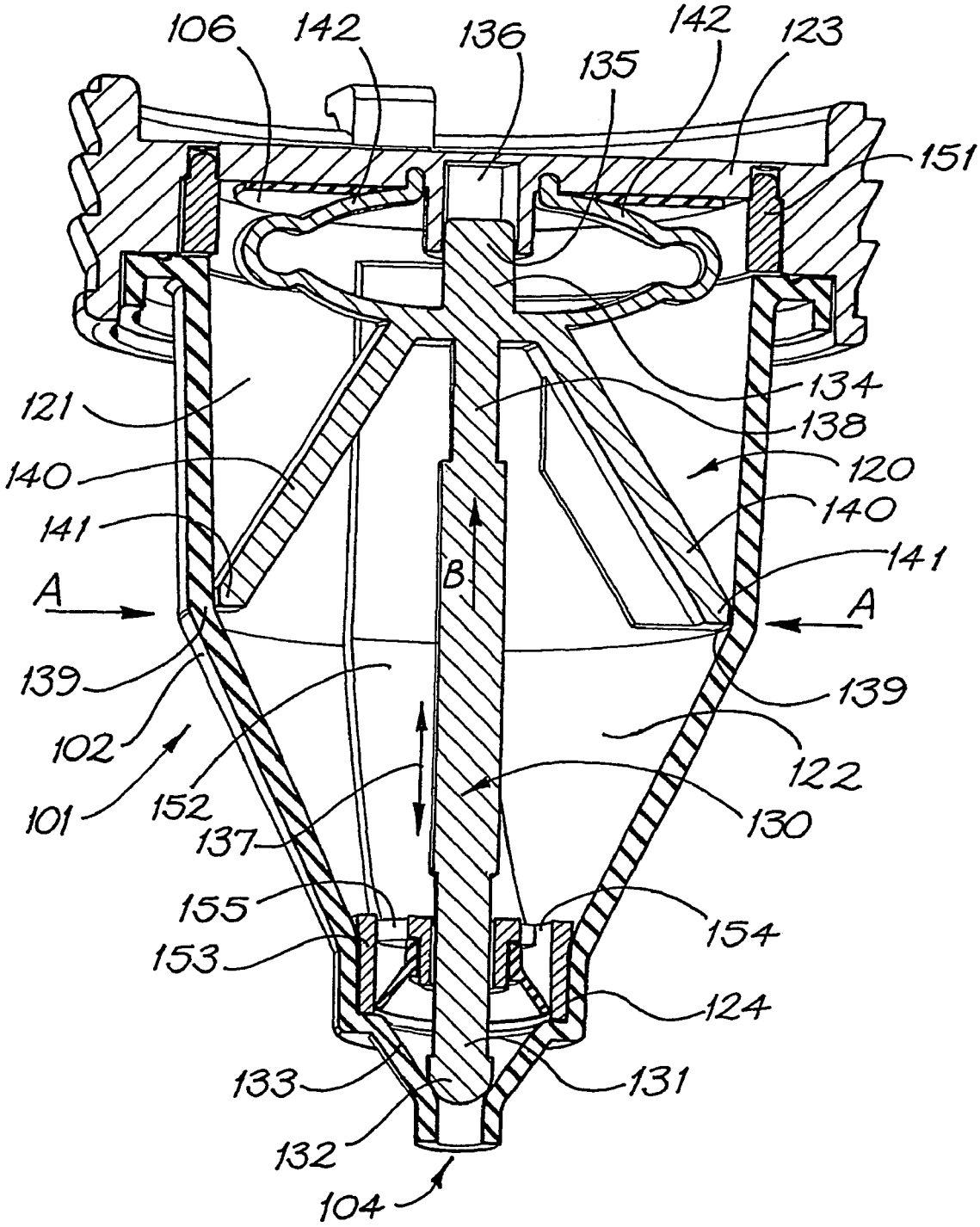
FIG. 6 depicts a cross-sectional elevation view of a fourth preferred embodiment of the dispenser.
Figure 7:
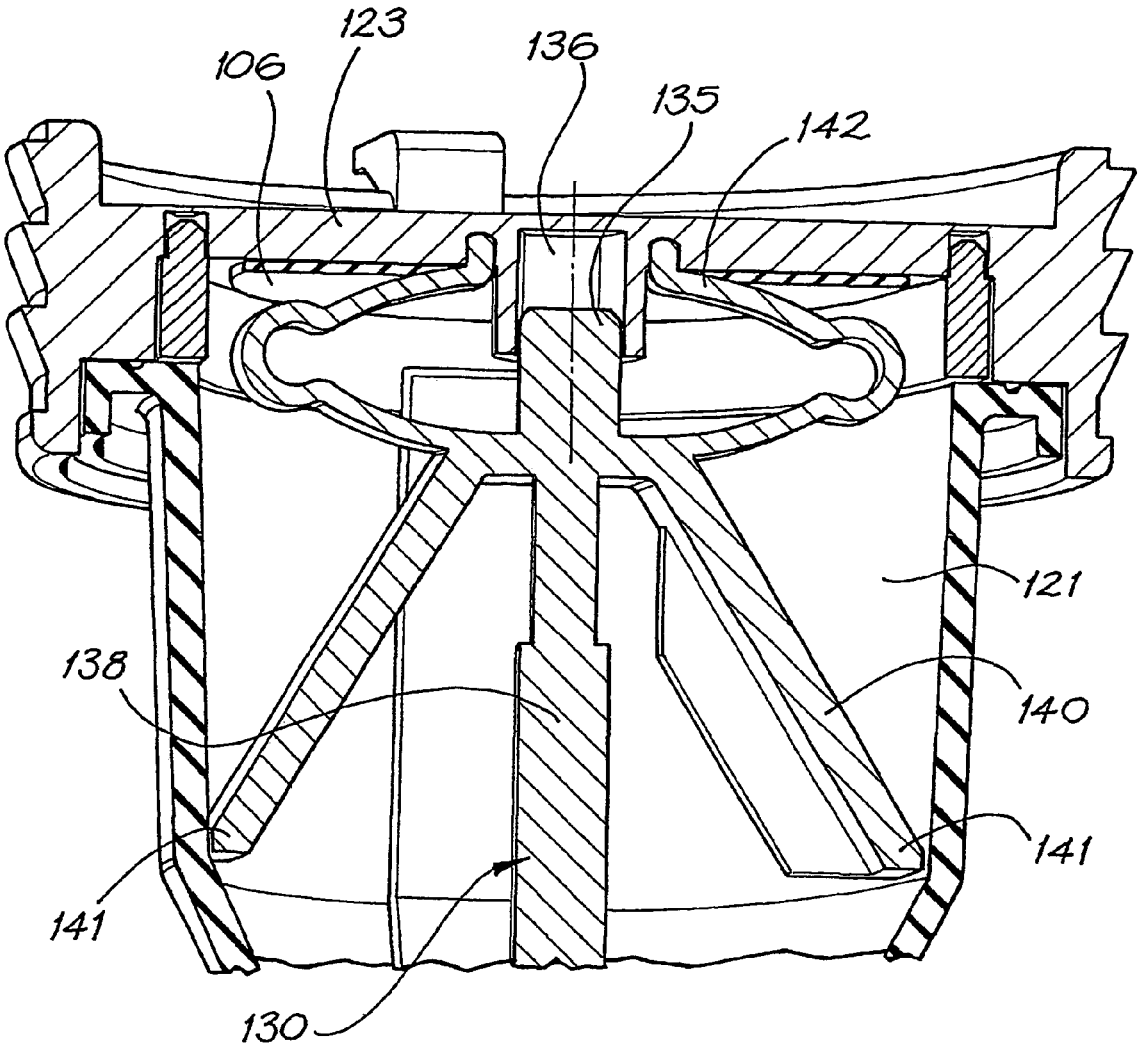
FIG. 7 depicts an enlarged cross-sectional view of the inlet section of the dispenser depicted in FIG. 6.

In the embodiment of FIGS. 6 to 10 the pump 101 includes a pump body 102 formed from a flexible walled member. The pump body 102 is preferably formed by moulding a suitably resilient material, such as silicone or a similar rubber-like material, although it should be noted that other materials and production methods may be used. The pump body 102 is deformable between a rest configuration as shown in FIG. 6 and a squeezed configuration, the internal capacity of the pump body being substantially reduced in the latter configuration. In the preferred embodiment depicted, the pump body 102 defines a pump chamber 120 comprising an upper cylindrical section 121 and a lower, conical section 122. A cap 123 is fitted to the open end of the upper cylindrical section 121 so as to close the upper end of the pump chamber. The lower conical section 122 includes an outlet 104 from which flowable material is dispensed from the pump chamber. The cap 123 includes an inlet 105 (not shown), the inlet being controlled by a unidirectional flap valve 106. As is best illustrated in FIGS. 6 and 7, the flap valve 106 takes the form of an annulus which is mounted on the inside of the cap 123. The flap valve is formed from a suitably flexible material. The material to be dispensed flows through the inlet 105 via the flap valve 106 from a reservoir (not shown). In use, the dispenser is attached to a reservoir, such as a bag, of flowable material.

In this embodiment, the pump includes an internal sealing member 130 which acts to control the dispensing of material from the pump chamber 120. The internal member 130 is preferably moulded from a flexible, resilient material such as plastic, nylon, polypropylene or the like. The internal member 130 is centrally located on the longitudinal axis of the pump chamber. One end 131 of the internal member is provided with a rounded nose 132 which seats against the internal wall 133 of the conical section of the outlet so as to provide sealing of the outlet. The opposing end 134 of the member is provided with a locating stem 135 which is received within a mating recess 136 in the cap of the pump assembly so as to locate and guide the internal member within the pump chamber. The stem 135 is capable of sliding movement within the recess 136 so as to allow the member 130 a degree of translational movement along the longitudinal axis as indicated by the arrows 137.

The sealing member 130 further includes a plurality of arms 140 which extend outwardly and downwardly from the main body 138 of the member 130, the arms 140 being joined to the body and capable of pivoting towards and away from the main body 138. The free ends 141 of the arms 140 seat against the inner walls of the pump body, and more particularly seat against the inner wall of the pump body at the junction 139 between the upper cylindrical section and the lower conical section of the pump chamber. The resilient nature of the material from which the member 130 is made means that if a dispensing force is applied by a user so as to cause the arms to flex inwardly towards the main body of the member, an opposing force will cause the arms to return to their rest position upon removal of the dispensing force by the user.

Figure 9:
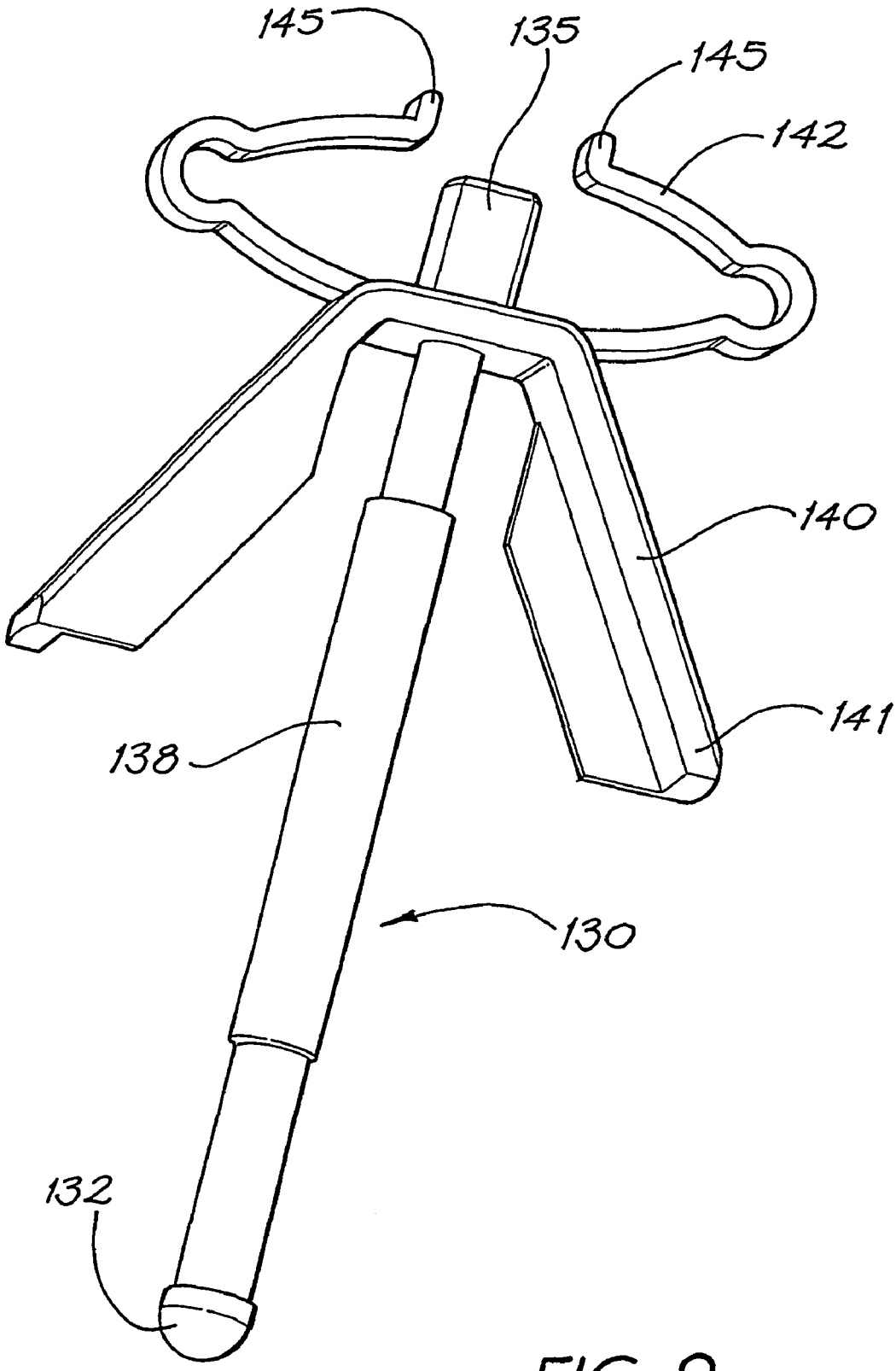
FIG. 9 depicts the sealing member of the dispenser assembly depicted in FIG. 6.

The sealing member 130 also carries a biasing element which acts to bias the sealing member to a position whereby the nose 132 seats against the tapered internal wall 133 of the outlet 104 so as to seal the outlet. In the preferred embodiment depicted, the biasing element comprises a pair of opposing fingers 142 which are integrally formed with the body of the member 130. The fingers extend upwardly from the member and seat against an inner surface of the cap 123. More particularly, the biasing element comprises a pair of opposing fingers 142 configured to form leaf springs which seat against the inner surface of the cap 123. As is best illustrated in FIG. 9 the free ends of the fingers 142 are provided with locating lugs 145 which engage in complementary slots in the inner surface of the cap 123. As the member is caused to move towards the cap the flexure of the fingers provides a biasing resistance in the opposing direction such that upon removal of the force by the user the member is caused to move in the opposing direction thereby returning the nose 132 into a sealing position against the tapered inner walls 133 of the outlet 104 so as to seal the outlet.

It is to be noted that instead of the biasing element being integrally formed on the sealing member 130, the biasing element may be a separate component. For example, biasing of the sealing member may be provided by means of a separate coil or leaf spring located within the pump body and positioned so as to apply a biasing force to the sealing member to return the member to a sealing position. However, it should also be noted that such alternatives may have limitations in terms of added complexity of manufacture and assembly of the pump.

Figure 10:
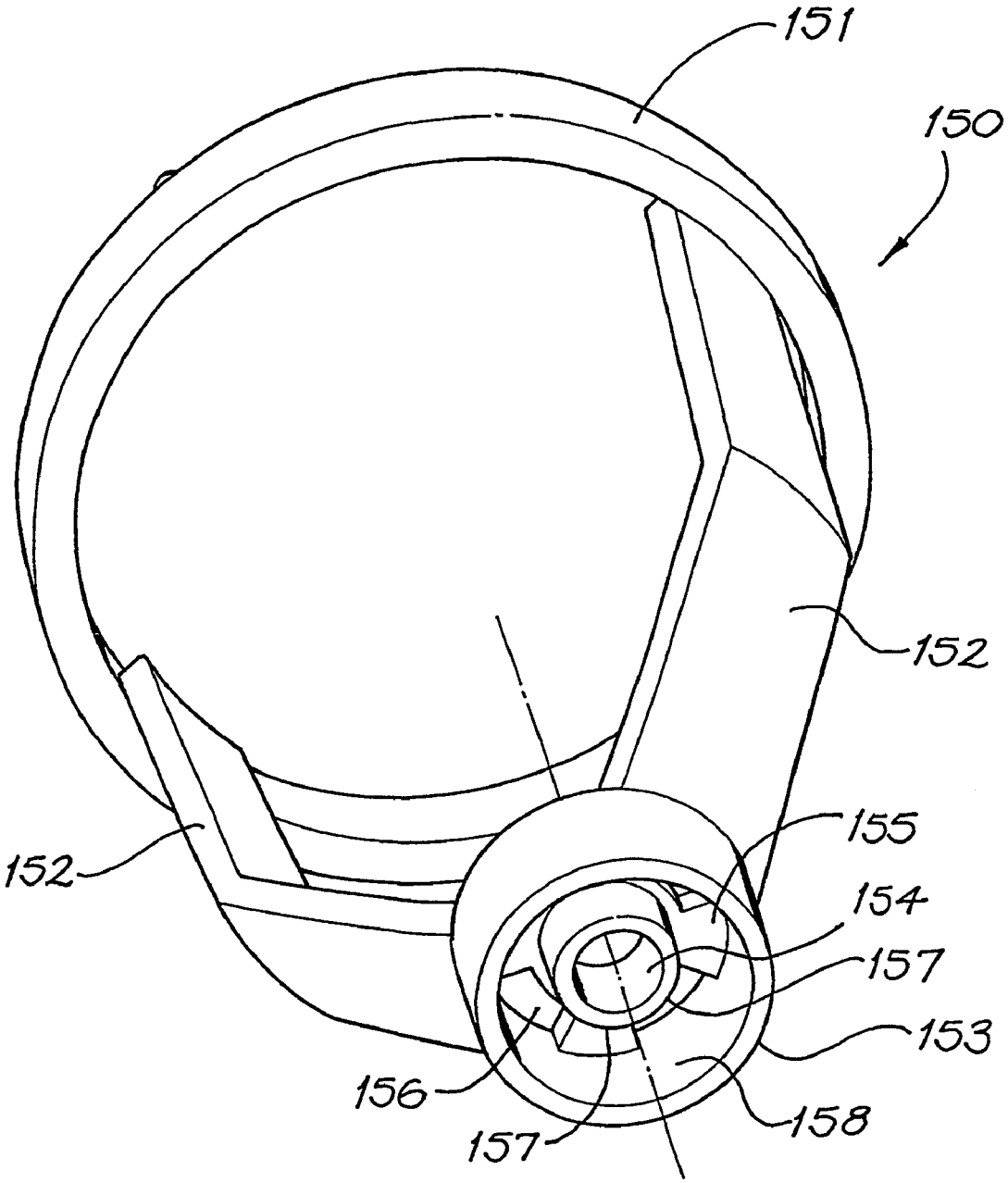
FIG. 10 depicts an internal support frame component of the dispenser assembly depicted in FIG. 6.

As is best depicted in FIGS. 6 and 10, the pump assembly further includes a internal frame component 150 which acts as a guide for the translational movement of the sealing member 130. The frame includes an annular section 151 from which extends two or more arms 152. The arms connect to a cylindrical boss 153 which includes a centrally located aperture 154 through which the sealing member 130 passes. The aperture 154 is sized and shaped so as to allow sliding movement of the sealing member and provide guidance for the movement of the member 130. The cylindrical boss 153 seats in a complementary recess 124 located in the lower section of the chamber 122. The boss includes an upper wall 155 which includes a plurality of apertures 156 through which the flowable material passes in moving from the pump chamber to the outlet 104.

Figure 8:
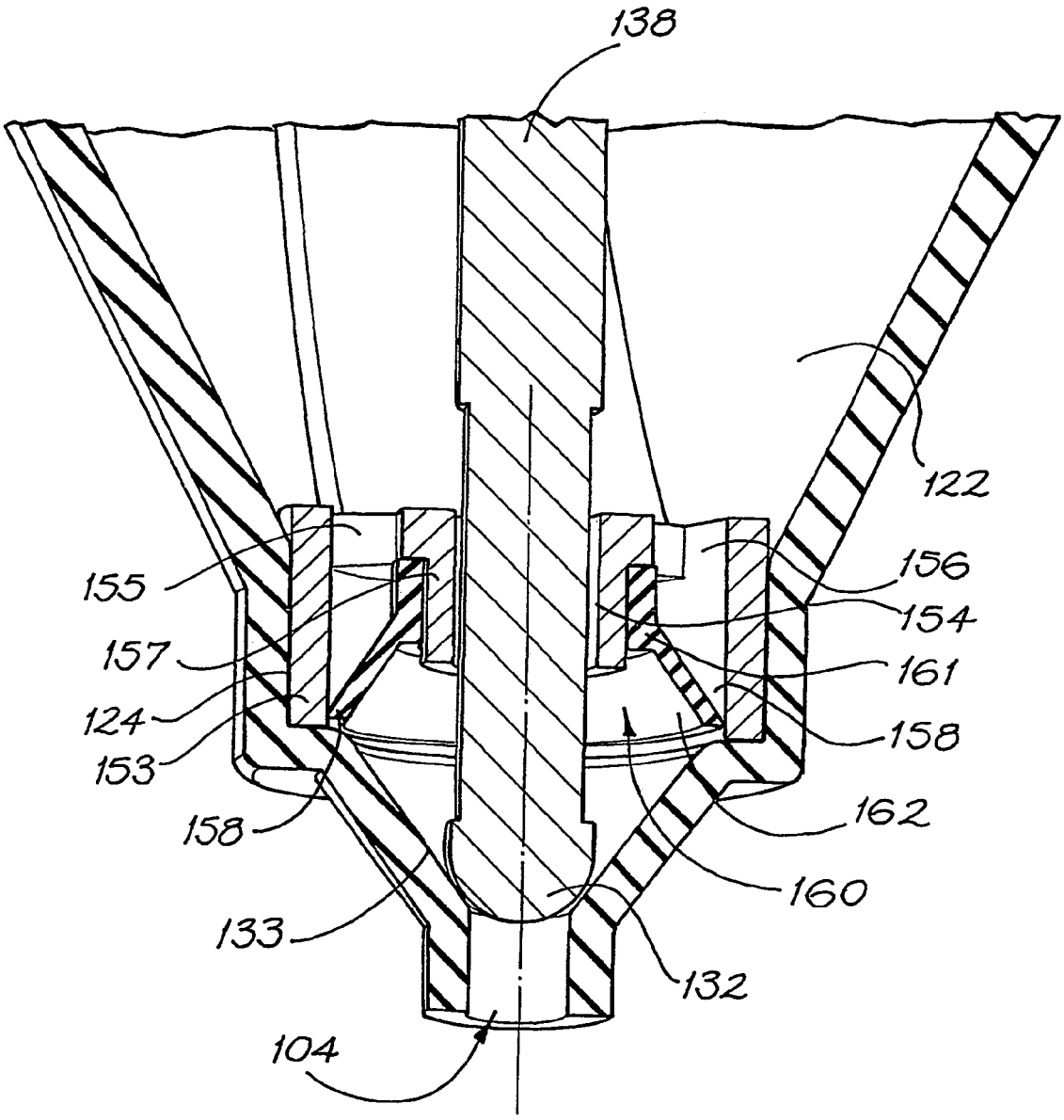
FIG. 8 depicts an enlarged cross-sectional view of the outlet section of the dispenser depicted in FIG. 6.

Centrally located around the aperture 154 is an annular boss 157 upon which is mounted an internal valve 160 which is configured to allow liquid material to flow past the valve but to act to prevent air from entering into the pump chamber. As is best illustrated in FIG. 8, the valve includes a annular body 161 from which extends a flexible walled skirt 162. The flexible walled skirt forms a conical flap valve, the lower edge of the flap valve seating against the internal wall 158 of the boss so as to act as a one-way valve and prevent the ingress of air into the pump chamber when the outward flow of material through the outlet 104 has been completed.

In use, to dispense flowable material the user applies a squeezing force to the pump body in the vicinity of the ends of the opposing arms 140 in the direction indicated by arrows A. The wall of the pump body is deformed inwardly and the arms 140 are caused to pivot inwardly towards the body of the member 130. This causes the member 130 to move in direction B, thereby moving the nose section 132 away from sealing contact with the internal wall 133 of the outlet. In moving upwardly the resilient fingers 142 are caused to be deformed downwardly thereby creating an opposing biasing force. The reduction in the internal volume of the pump chamber 120 causes an increase in the pressure within the pump body thereby leading to the flowable material being dispensed from the outlet 104.

When the wall of the pump body is released the resilient nature of the wall causes it to return to its rest position. The fingers 142 located on the upper end of the sealing member 130 act to return the sealing member to a sealing position shown in FIG. 6.

As with the embodiment depicted in FIG. 3, whilst the sealing member 130 depicted in FIGS. 6 to 10 features two opposing arms 140, it is to be appreciated that the sealing member may be provided with a greater number of arms. In a further alternative embodiment, the opposing arms may be replaced with a resiliently deformable disc which would provide the same degree of biasing and controlled movement through the deformation of the disk walls upon the application of a dispensing force by a user.

Advantageously the present invention provides a dispenser which is economic to manufacture and which provides consistent volumetric output for each activation of the pump. Additionally, higher than normal dosages are achievable.

Although the invention has been described with reference to specific examples it will be appreciated by those skilled in the art that the invention may be embodied in many other forms.

What is claimed is:

1. A pump for dispensing a flowable material from a container, said pump including:

a flexible walled pump body moulded from a resilient material and deformable between a rest configuration and a squeezed configuration, said pump body defining a pump chamber, the internal capacity of the pump chamber being substantially reduced in the squeezed configuration compared to the rest configuration;

a unidirectional valve to allow ingress of said flowable material into said pump chamber from said container;

an outlet to allow egress of said flowable material from said pump chamber;

a sealing member located inside the pump chamber which acts to seal the outlet of the pump chamber, said sealing member mounted for translational movement between a first, sealing position and a second, non-sealing position;

a biasing means which acts to bias the sealing member to said first position whereby the sealing member seals the outlet of the pump chamber;

wherein application of a dispensing force to said pump body causes translational movement of said sealing member from said first position to said second position to permit said flowable material to flow through said outlet.

2. The pump as claimed in claim 1, wherein said pump chamber comprises a cylindrical section and a conical section, said conical section including said outlet from which flowable material is dispensed from the pump chamber.

3. The pump as claimed in claim 2, wherein one end of the sealing member seats against an internal wall of said conical section of the pump chamber so as to provide sealing of the outlet.

4. The pump as claimed in claim 1, wherein the pump further includes a boss through which the sealing member extends, said boss acting to guide the translational movement of the sealing member between said first and said second positions.

5. The pump as claimed in claim 4, wherein the pump further includes a valve mounted on said boss, said valve including a body from which extends a flexible walled skirt, said flexible walled skirt forming a flap valve which acts as a one way valve to prevent the ingress of air into the pump chamber when flow of said flowable material through the outlet has been completed.

6. The pump as claimed in claim 4, wherein said boss seats in a complementary recess located in the conical section of the pump chamber.

7. The pump as claimed in claim 3, wherein the boss includes one or more apertures through which the flowable material passes in moving from the pump chamber to the outlet.

8. The pump as claimed in claim 3, wherein said boss is carried by a frame, said frame including an annular member from which extends two or more arms which connect to said boss.

9. The pump as claimed in claim 1, wherein an opposing end of the sealing member is provided with a locating stem which is slidably received within a mating recess in a closure over the open end of the pump chamber to provide for the location and guidance of the sealing member within the pump chamber.

10. The pump as claimed in claim 1, wherein the sealing member includes a longitudinally extending body and a plurality of arms pivotally attached to the body, said arms extending outwardly and downwardly from said body with free ends of the arms seating against an inner wall of the pump chamber.

11. The pump as claimed in claim 10, wherein said free ends of the arms seat against an inner wall of the pump chamber at a junction between the cylindrical section and the conical section of the pump chamber.

12. The pump as claimed in claim 1, wherein said biasing means comprises a pair of opposing fingers which extend from the sealing member and seat against an inner surface of a closure over the open end of the pump chamber, wherein as the sealing member is caused to move towards the cap the flexure of the fingers provides a biasing resistance in the opposing direction such that upon removal of the dispensing force by the user the sealing member is caused to move in the opposing direction thereby returning the sealing member to said first position.

13. The pump as claimed in claim 12, wherein said opposing fingers include locating lugs which engage in complementary slots on the inner surface of the closure.

14. The pump as claimed in claim 1, wherein said biasing means is integrally formed on said sealing member.

15. The pump as claimed in claim 1, wherein said pump body is moulded from a silicon or rubber-like material.

16. The pump as claimed in claim 1, wherein said unidirectional valve is a flap valve.

17. The pump as claimed in claim 1, wherein said sealing member is located on the longitudinal axis of the pump chamber.

18. The pump as claimed in claim 1, wherein the sealing member is moulded from a flexible, resilient material.

* * * * *